US008794111B2

(12) United States Patent
Wang

(10) Patent No.: US 8,794,111 B2
(45) Date of Patent: Aug. 5, 2014

(54) HAND TOOL

(75) Inventor: Cheng-Hui Wang, New Taipei (TW)

(73) Assignee: EZConn Corporation, Taipei (TW)

( * ) Notice: Subject to any disclaimer, the term of this patent is extended or adjusted under 35 U.S.C. 154(b) by 260 days.

(21) Appl. No.: 13/137,644

(22) Filed: Aug. 31, 2011

(65) Prior Publication Data

US 2013/0047800 A1 Feb. 28, 2013

(51) Int. Cl.
*B25B 13/48* (2006.01)

(52) U.S. Cl.
USPC ..... 81/124.2; 81/475

(58) Field of Classification Search
USPC ..... 81/124.2, 467, 475, 477, 58, 58.2, 81/177.8
See application file for complete search history.

(56) References Cited

U.S. PATENT DOCUMENTS 1,328,087 A * 1/1920 Le Chot ..... 81/475
2,578,687 A * 12/1951 Fish ..... 81/58.2
3,010,346 A * 11/1961 Kulp ..... 81/124.2
7,080,581 B2 * 7/2006 Reese ..... 81/475

* cited by examiner

*Primary Examiner* — David B Thomas
(74) *Attorney, Agent, or Firm* — Min-Lee Teng; Litron Patent & Trademark Office

(57) ABSTRACT

A hand tool includes a tool shaft having a shank and a handle pivotally coupled together, and a tool head, which includes a socket defining a socket hole attachable to a locknut at a coaxial cable for fastening or loosening the locknut and a side opening for the passing of the locknut into or out of the socket hole, a driven structure located on an inner side of a receiving hole at one side of the socket hole, a transmission shaft coupled to the shank of the tool shaft and having a driving head located on one end thereof for engagement with the driven structure of the socket, and an elastic member stopped between the driving head and the socket such that when the socket reaches a predetermined torque value during operation, the driving head is moved axially away from the driven structure to compress the elastic member and to run idle.

20 Claims, 9 Drawing Sheets

HAND TOOL

BACKGROUND OF THE INVENTION

1. Field of the Invention

The present invention relates to hand tools and more particularly, to a hand tool for fastening a locknut of a coaxial cable to a connection screw rod of an electrical connector at an electronic device of a cable TV system, which automatically runs idle when the socket thereof reaches a predetermined torque value during operation, avoiding damage.

2. Description of the Related Art

CATV (Community antenna television or community access television) is known as cable TV that brings television programs to people throughout the world who are connected to a community antenna. Cable television provides television programs to consumers via radio frequency signals transmitted to televisions through coaxial cables or digital light pulses through fixed optical fibers located on the subscriber's property. In addition to bringing television programs to consumers, cable TV is a good way to interact with the World Wide Web and other new forms of multimedia information and entertainment services.

Further, when connecting a coaxial cable to a signal distributor, a locknut is used to lock the signal connector at the end of the coaxial cable to a mating electrical connector at the signal distributor. During installation, a wrench is needed to fasten tight the locknut. FIG. 9 illustrates a conventional wrench for this purpose. As illustrated, the wrench comprises a link A, and two sockets B respectively arranged at the two distal ends of the link A at right angles. Each socket B defines a socket hole B1 and a side opening B11. As the two sockets B are arranged at right angles, they can be selectively used for fastening/unfastening a locknut at different angles. However, when the user bias the link A to rotate one socket B in fastening the locknut to the mating electrical connector at the signal distributor, an excessive high pressure may be applied, causing locknut or socket damage. When the locknut or the socket starts to wear, the user may be unable to rotate the locknut positively. Thus, this design of wrench is not durable in use.

SUMMARY OF THE INVENTION

The present invention has been accomplished under the circumstances in view. It is the main object of the present invention to provide a hand tool, which is practical for fastening a locknut of a coaxial cable to a matching electrical connector at a signal distributor of a cable TV and will automatically run idle when the socket thereof reaches a predetermined torque value during operation, avoiding damage.

To achieve these and other objects of the present invention, a hand tool comprises a tool shaft and a tool head. The tool shaft comprises a shank and a handle pivotally coupled together. The tool head comprises a socket defining a socket hole attachable to a locknut at a coaxial cable for fastening or loosening the locknut and a side opening for the passing of the locknut into or out of the socket hole, a driven structure located on an inner side of a receiving hole at one side of the socket hole, a transmission shaft coupled to the shank of the tool shaft and having a driving head located on one end thereof for engagement with the driven structure of the socket, and an elastic member stopped between the driving head and the socket such that when the socket reaches a predetermined torque value during operation, the driving head is moved axially away from the driven structure to compress the elastic member and to run idle.

Further, the driving head of the transmission shaft comprises a plurality of tooth block for engagement with respective stop blocks of the driven structure. Each stop block of the driven structure comprises opposing push face and vertical stop face. Each tooth block of the driving head comprises opposing sloping face and vertical face. Further, the vertical faces of the tooth blocks of the driving head are forced against the vertical stop faces of the stop blocks of the driven structure to rotate the socket when the transmission shaft is driven by the tool shaft. Further, the sloping faces of the tooth blocks of the driving head are moved along the push faces of the stop blocks of the driven structure in direction away from the driven structure when the socket reaches the predetermined torque value during rotation.

Further, the socket, the transmission shaft and the compression spring are detachable, facilitating replacement of a different design of socket or a compression spring having a different coefficient of elasticity to fit different application requirements.

DETAILED DESCRIPTION OF THE PREFERRED EMBODIMENT

Figure 1:
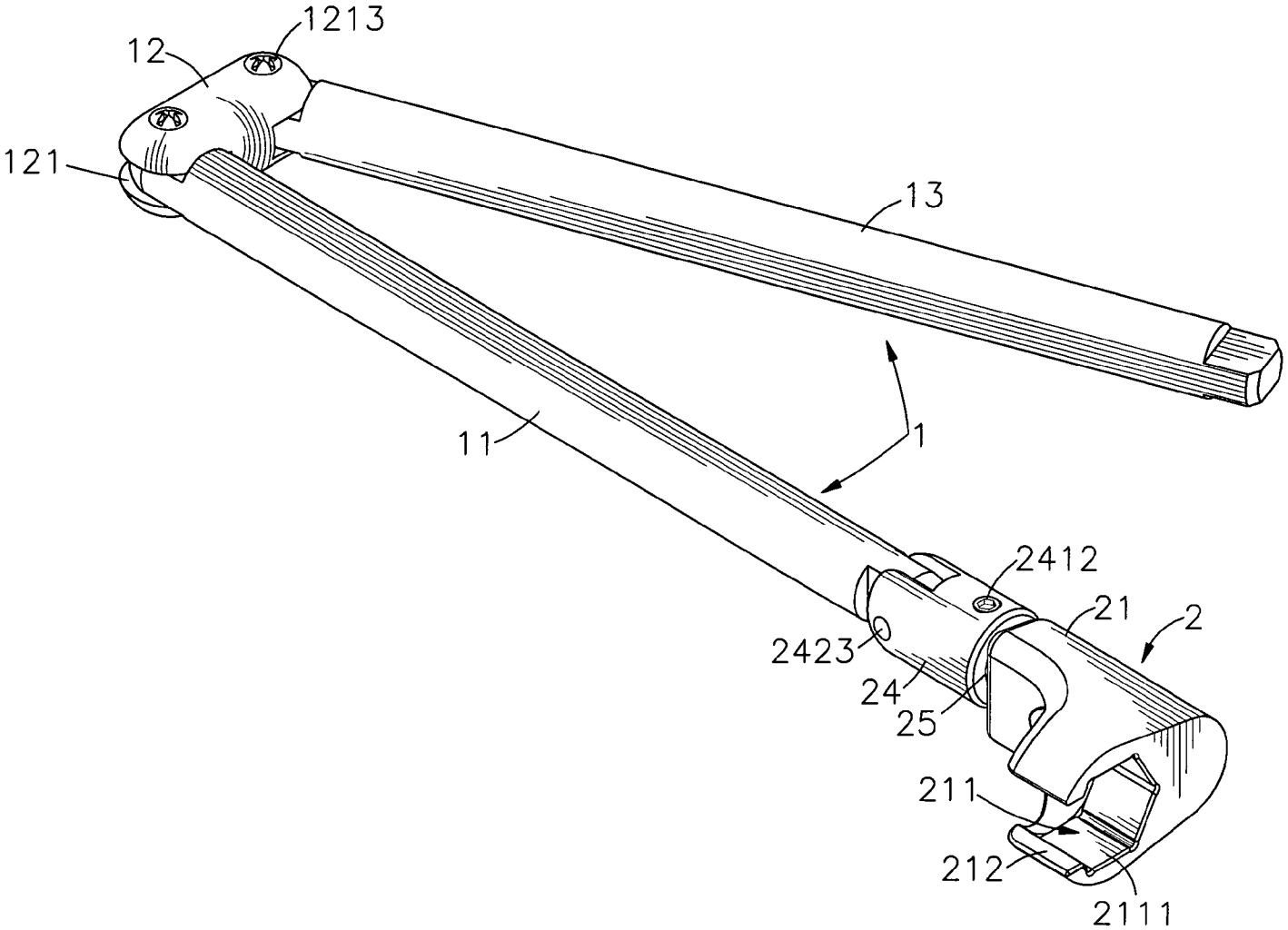
FIG. 1 is an elevational view of a hand tool in accordance with a first embodiment of the present invention.
Figure 2:
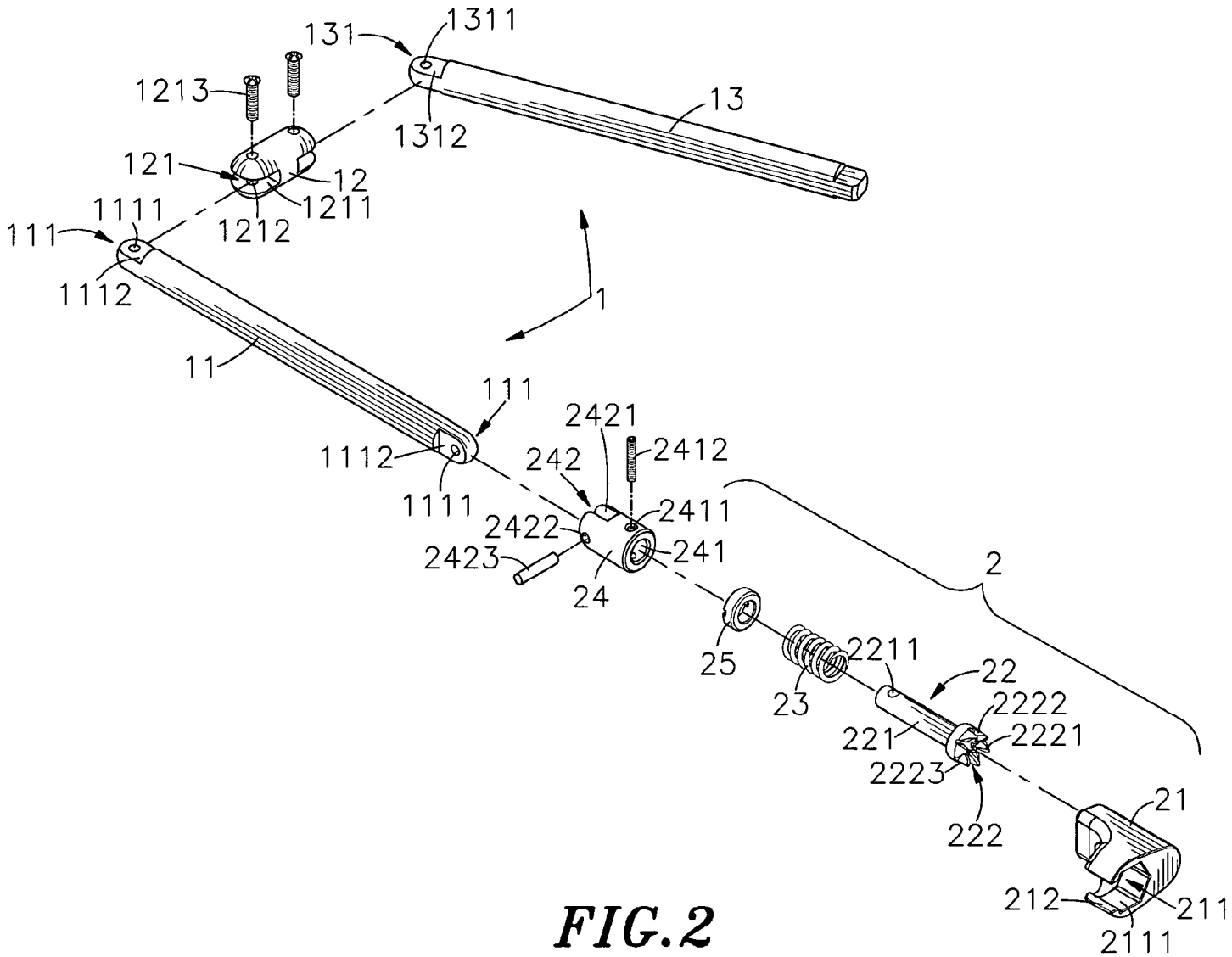
FIG. 2 is an exploded view of the hand tool in accordance with the first embodiment of the present invention FIG. 3 corresponds to FIG. 2 when viewed from another angle.
Figure 3:
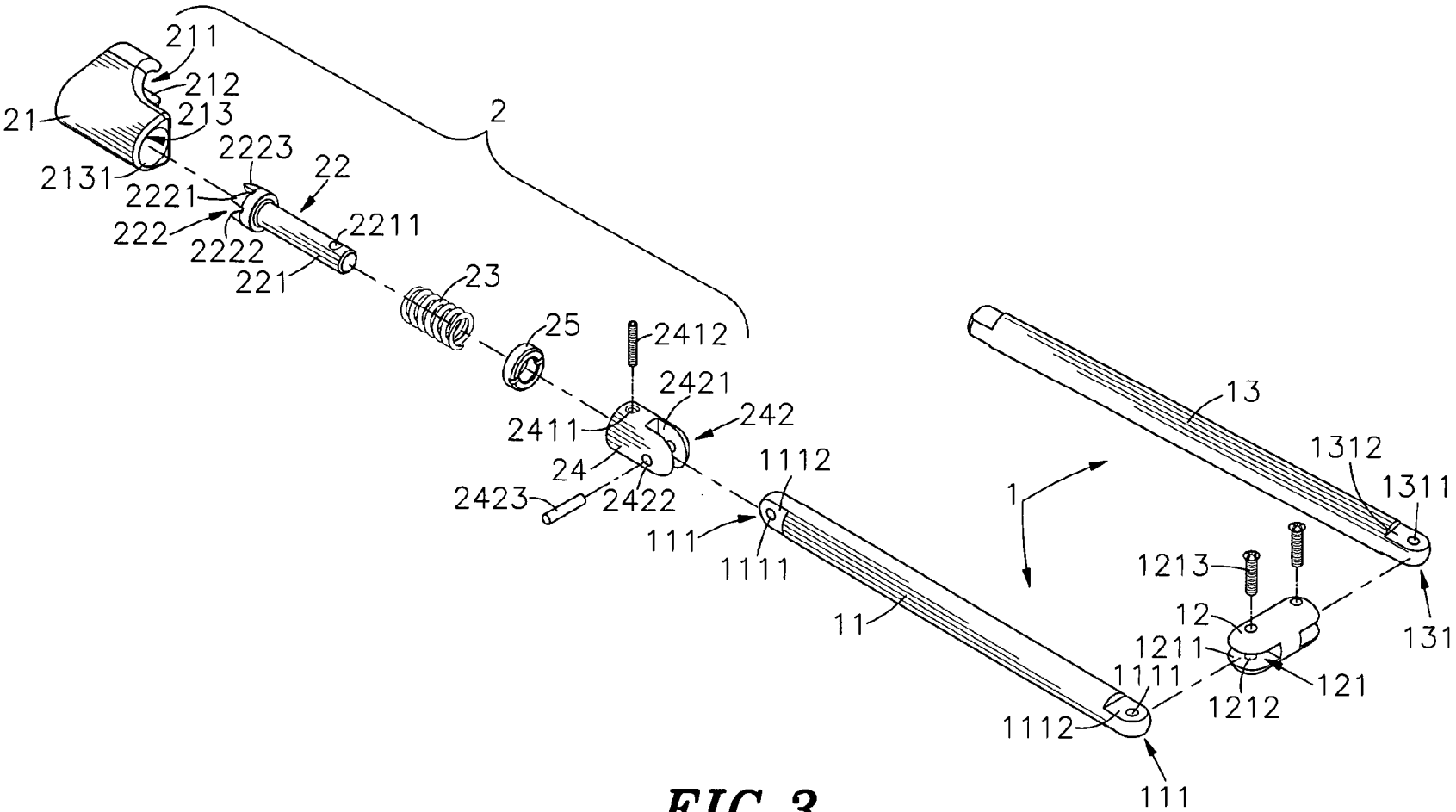
Figure 4:
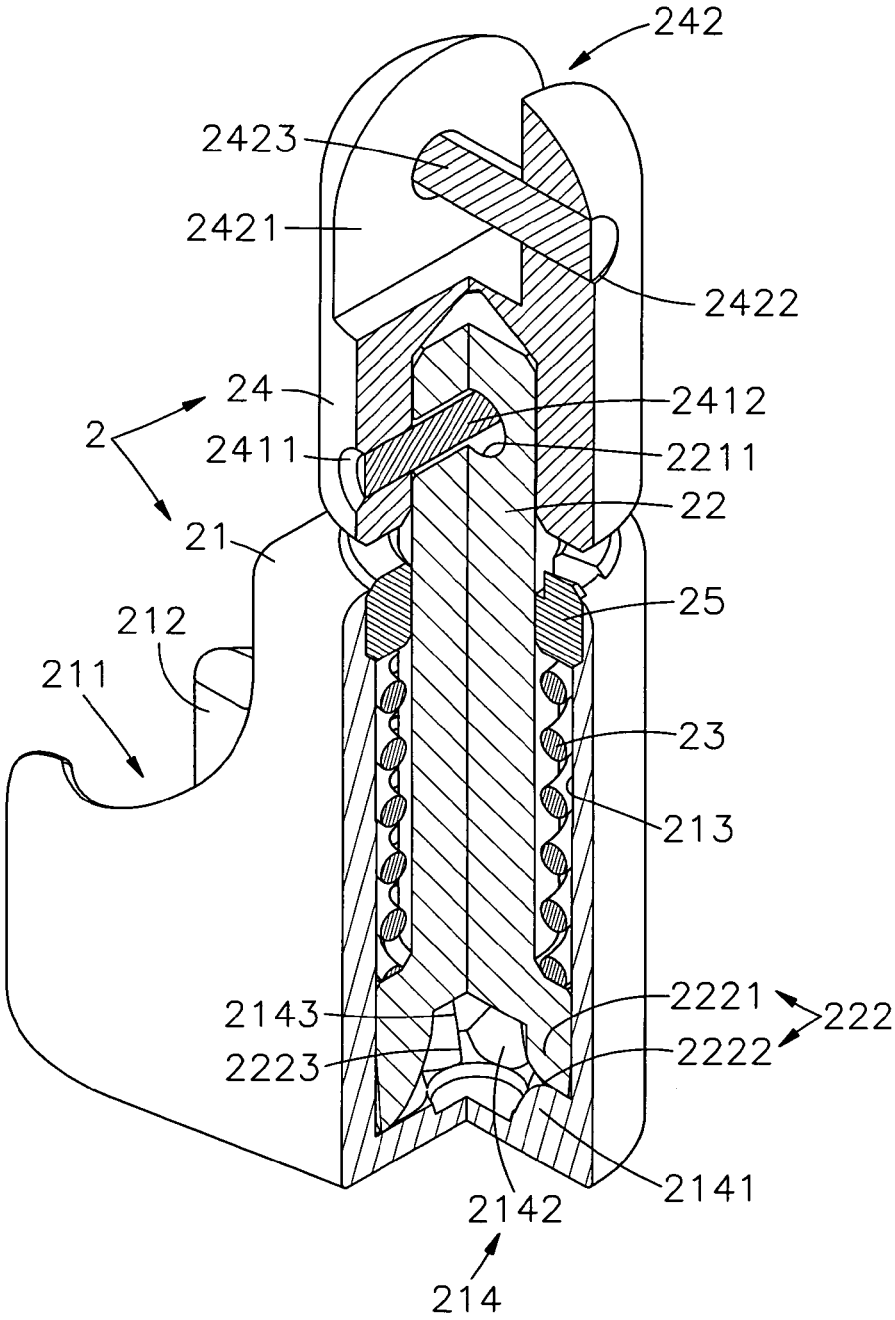
FIG. 4 is a sectional elevation of a part of the hand tool in accordance with the first embodiment of the present invention.
Figure 5:
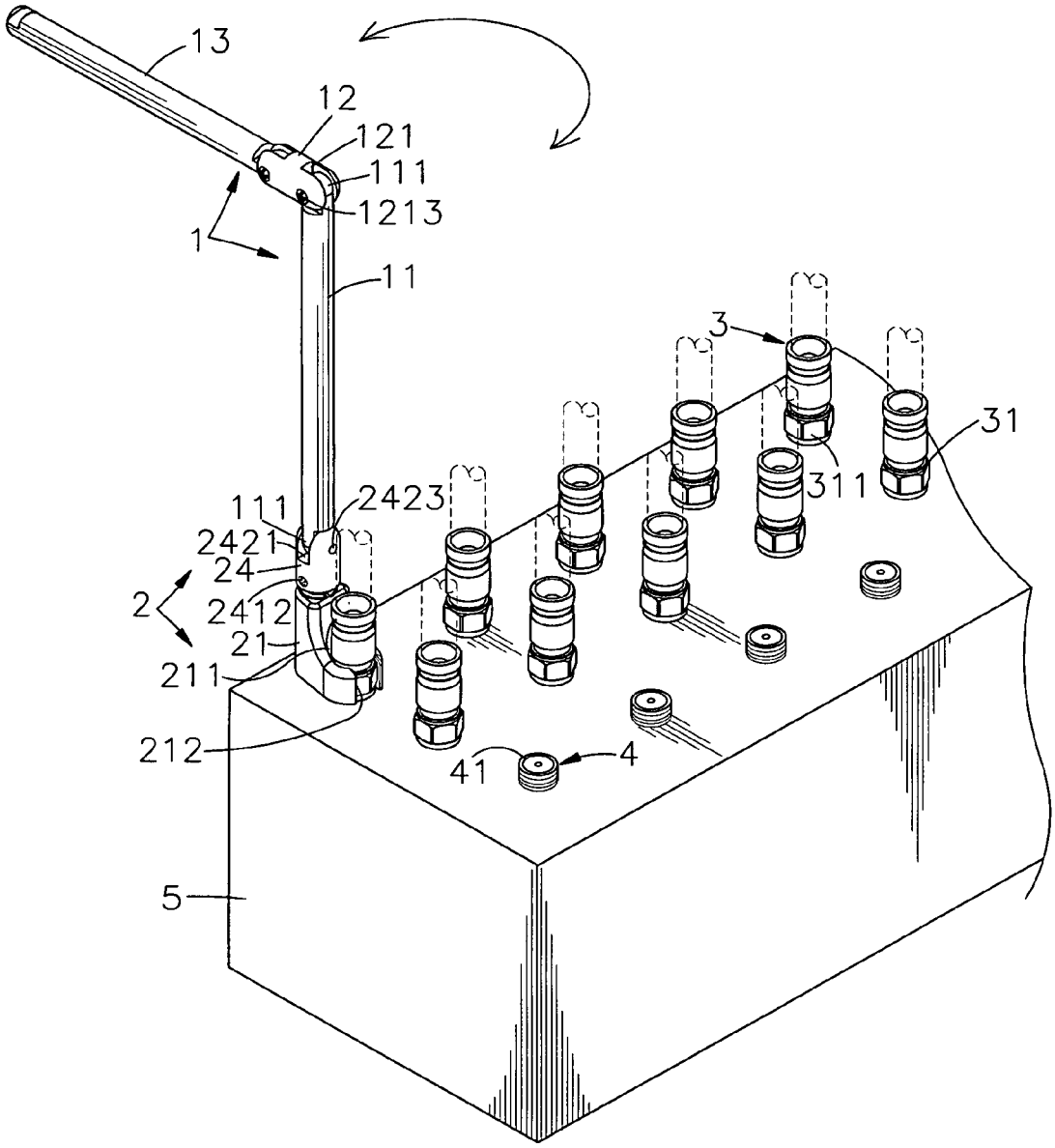
FIG. 5 is a schematic applied view of the first embodiment of the present invention, illustrating an operation status of the hand tool.
Figure 6:
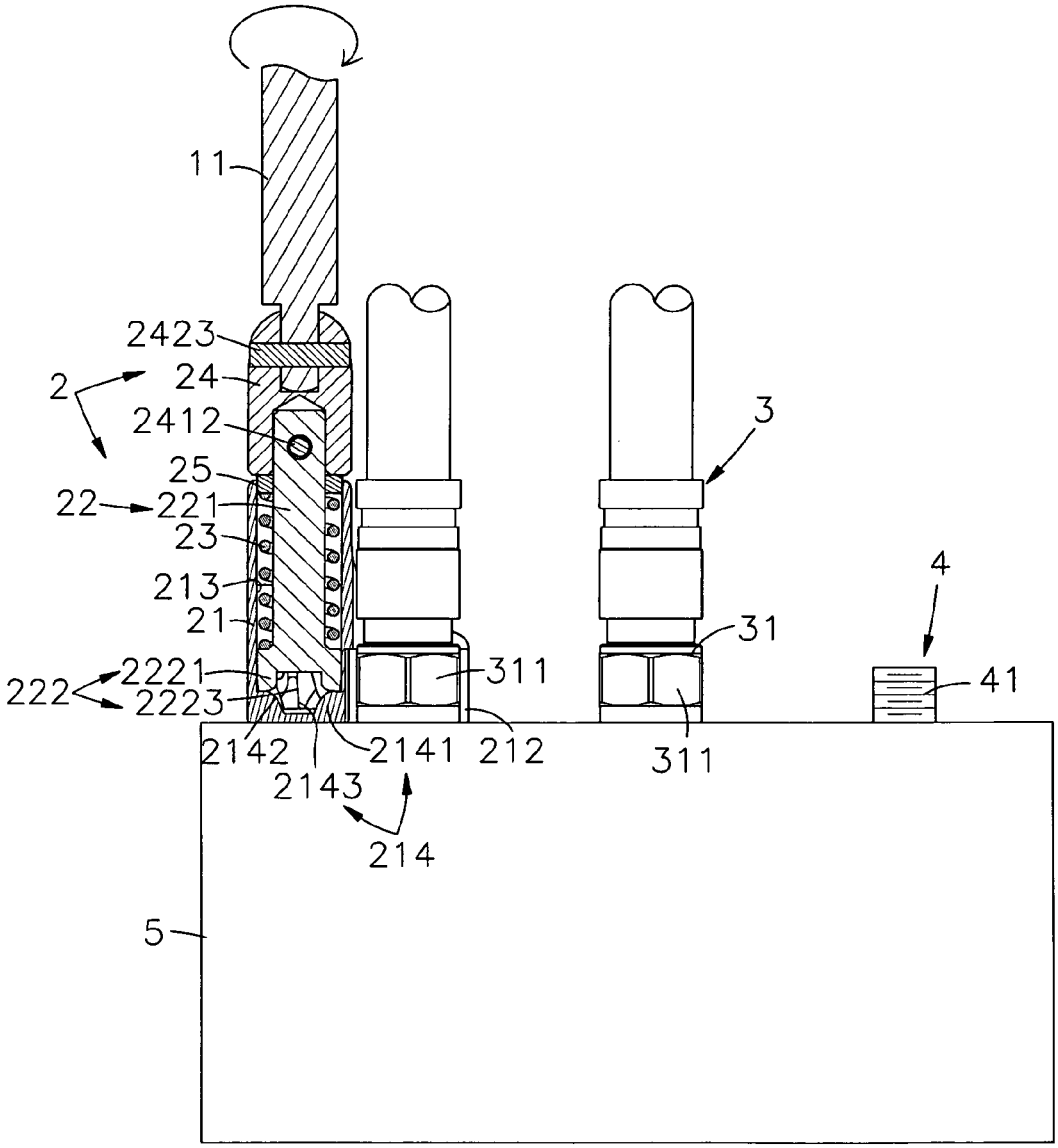
FIG. 6 is a sectional view, in an enlarged scale, of a part of FIG. 5.
Figure 7:
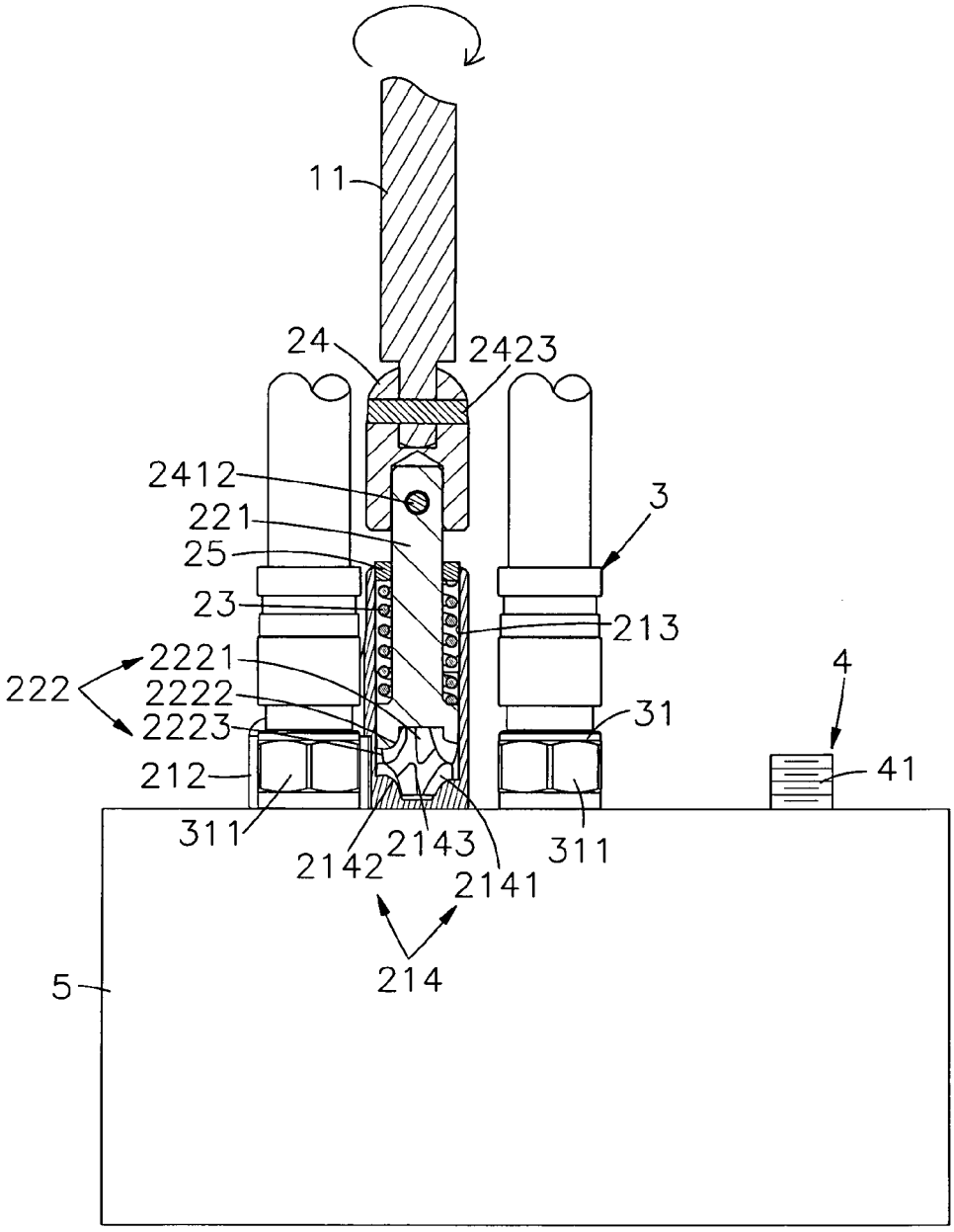
FIG. 7 is a schematic sectional view of the first embodiment of the present invention, illustrating another application example of the hand tool.

Referring to FIGS. 1~5, a hand tool in accordance with a first embodiment of the present invention is shown comprising a tool shaft 1 and a tool head 2.

The tool shaft 1 comprises a shank 11, a handle 13, a coupling block 12 coupled between the shank 11 and the handle 13, and two pivot screws 1213.

The shank 11 comprises two coupling end portions 111 respectively located on the two distal ends thereof. Each coupling end portion 111 comprises two opposing cut planes 1112 and a pivot hole 1111 cut through the opposing cut planes 1112. The pivot holes 1111 of the two coupling end portions 111 extend in different directions, for example, at right angles.

The handle 13 comprises a coupling end portion 131 located on one end thereof. The coupling end portion 131 comprises two opposing cut planes 1312 and a pivot hole 1311 cut through the opposing cut planes 1312.

The coupling block 12 comprises two flat coupling notches 121 symmetrically disposed at two opposite sides, two pairs of opposing flat inside walls 1211 respectively disposed at two opposite sides relative to the two flat coupling notches 121, and two screw holes 1212 respectively extending through the two pairs of opposing flat inside walls 1211.

The two pivot screws 1213 are respectively threaded into the screw holes 1212 of the coupling block 12 and inserted through the pivot hole 1111 of one coupling end portion 111 of the shank 11 and the pivot hole 1311 of the coupling end portion 131 of the handle 13 to pivotally connect the shank 11 and the handle 13 together, keeping the opposing cut planes 1112 of the respective coupling end portion 111 of the shank 11 and the opposing cut planes 1312 of the coupling end portion 131 of the handle 13 in close contact with the respective flat inside walls 1211 of the coupling block 12.

The tool head 2 is coupled to the other coupling end portion 111 of the shank 11 of the tool shaft 1, comprising a socket 21, a transmission shaft 22, an elastic member, for example, a compression spring 23, and a connection member 24.

The socket 21 comprises a socket hole 211 extending axially forwards and having at least one pair of opposing bearing faces 2111 defined therein and attachable to a locknut 31 at a coaxial cable 3 for fastening or loosening the locknut 31 (see FIG. 5), a side opening 212 located on one lateral side of the socket hole 211 in communication with the outside space, a receiving hole 213 disposed at an opposite lateral side relative to the socket hole 211, and a driven structure 214 located on the inner side of the receiving hole 213 opposite to the front opening 2131 side of the receiving hole 213. The driven structure 214 consists of a plurality of stop blocks 2141. Each stop block 2141 has a opposing push face 2142 and a vertical stop face 2143.

The transmission shaft 22 is accommodated in the receiving hole 213 of the socket 21, comprising a shaft body 221, a coupling hole 2211 transversely disposed at one end of the shaft body 221, and a driving head 222 located on the other end of the shaft body 221 for engagement with the driven structure 214 of the socket 21. The driving head 222 comprises a plurality of tooth blocks 2221 equiangularly arranged at one side thereof opposite to the shaft body 221. Each tooth block 2221 has a opposing sloping face 2222 and a vertical face 2223.

The compression spring 23 is sleeved onto the shaft body 221 of the transmission shaft 22 and stopped at the driving head 222.

The connection member 24 has an insertion hole 241 axially extended through one end thereof for receiving one end of the shaft body 221 of the transmission shaft 22, a mounting screw hole 2411 transversely extending across the insertion hole 241, a screw rod 2412 threaded into the mounting screw hole 2411 and inserted through the coupling hole 2211 of the shaft body 221 of the transmission shaft 22 to connect the connection member 24 to the transmission shaft 22, a flat coupling notch 242 disposed at the opposite end thereof, two opposing flat inside walls 2421 respectively disposed at two opposite sides relative to the flat coupling notch 242, a pin hole 2422 extending through two opposing flat inside walls 2421, and a pin 2423 press-fitted into the pin hole 2422 and inserted through the pivot hole 1111 of the other coupling end portion 111 of the shank 11 to pivotally connect the shank 11 of the tool shaft 1 to the connection member 24.

Further, the diameter of the coupling hole 2211 of the shaft body 221 of the transmission shaft 22 is greater than the maximum outer diameter of the screw rod 2412 so that the transmission shaft 22 is slightly movable relative to the connection member 24 within a limited range.

The hand tool further comprises a axle bushing 25 mounted in the front opening 2131 of the receiving hole 213 of the socket 21 and sleeved onto the shaft body 221 of the transmission shaft 22 and stopped at one end of the compression spring 23 against the driving head 222 of the transmission shaft 22. However, the axle bushing 25 is not a requisite member. Alternatively, the compression spring 23 can be mounted around the shaft body 221 of the transmission shaft 22 and stopped between the driving head 222 of the transmission shaft 22 and the connection member 24.

Referring to FIGS. 4~8, the hand tool of the invention is practical for use in a cable TV system for fastening a coaxial cable 3 to one connection screw rod 41 of an electrical connector 4 at an electronic device 5, such as signal distributor or adapter. During installation, insert the center conductor (not shown) of the coaxial cable 3 into the center contact hole at the center of the connection screw rod 41 of the electrical connector 4 and thread the locknut 31 at the coaxial cable 3 onto the connection screw rod 41 of the electrical connector 4 by labor, and then attach the socket 21 of the hand tool to the locknut 31 and operate the hand tool to fasten tight the locknut 31. By means of the side opening 212 of the socket 21, the locknut 31 can be conveniently inserted into the socket hole 211 to have a hexagonal periphery 311 of the locknut 31 be abutted against the opposing bearing faces 2111 of the socket 21. At this time, the user can hold the handle 13 at about 90-degrees angle relative to the shank 11 and then operate the handle 13 to rotate the shank 11 and the tool head 2, thereby fastening up the locknut 31. Subject to the coupling arrangement of the coupling block 12 between the shank 11 and the handle 13 and the coupling arrangement between the connection member 24 of the tool head 2 and the shank 11 of the tool shaft 1, the handle 13 can be adjusted to any desired angle relative to the socket 21 to fit different installation conditions, facilitating application in a narrow space.

During application of the hand tool, the compression spring 23 imparts a pressure to the driving head 222 of the transmission shaft 22 in direction away from the axle bushing 25 (or the connection member 24), forcing the tooth blocks 2221 of the driving head 222 into positive engagement with the stop blocks 2141 of the driven structure 214, and therefore the socket 21 can be positively driven by the tool shaft 1 to rotate the locknut 31 of the coaxial cable 3 relative to the connection screw rod 41 of the electrical connector 4 of the electronic device 5 to further fasten tight or loosen the locknut 31.

When the socket 21 reaches a predetermined torque value during operation of the tool shaft 2 to rotate the transmission shaft 22 of the tool head 2, the opposing sloping faces 2222 of the tooth blocks 2221 of the driving head 222 of the transmission shaft 22 are respectively abutted against the push faces 2142 of the respective stop blocks 2141 of the driven structured 214 of the socket 21. When continuously rotating the socket 21 at this time, subject to the design that the diameter of the coupling hole 2211 of the shaft body 221 of the transmission shaft 22 is greater than the maximum outer diameter of the screw rod 2412 for enabling the transmission shaft 22 to be slightly movable relative to the connection member 24 within a limited range, the tooth blocks 2221 of the driving head 222 will be moved over the stop blocks 2141 of the driven structured 214 of the socket 21 to run idle, avoiding damage and enhancing durability of the hand tool.

When the user wishes to loosen the locknut 31 of the coaxial cable 3 from the connection screw rod 41 of the electrical connector 4 of the electronic device 5, attach the socket 21 of the tool head 2 to the locknut 31 and then turn the handle 13 of the tool shaft 1 in the reversed direction to abut the vertical faces 2223 of the tooth blocks 2221 of the transmission shaft 22 of the tool head 2 against the vertical stop faces 2143 of the stop blocks 2141 of the driven structured 214 of the socket 21 and to further rotate the socket 21 and the locknut 31 relative to the connection screw rod 41 of the electrical connector 4. When loosening the locknut 31, the opposing bearing walls 2111 in the socket hole 211 of the socket 21 are respectively abutted against the hexagonal periphery 311 of the locknut 31, enabling the locknut 31 to be rotated by the socket 21 positively without causing damage. Further, the socket 21, the transmission shaft 22 and the compression spring 23 are detachable, facilitating replacement of a different design of socket or a compression spring having a different coefficient of elasticity to fit different application requirements.

Thus, when the user is going to loosen the locknut 31 of the coaxial cable 3, the user simply needs to rotate the handle 13 of the tool shaft 1 in the reversed direction. Subject to abutment between the vertical faces 2223 of the tooth blocks 2221 of the transmission shaft 22 of the tool head 2 and the vertical stop faces 2143 of the stop blocks 2141 of the driven structured 214 of the socket 21 and abutment between the opposing bearing walls 2111 of the socket 21 and the hexagonal periphery 311 of the locknut 31 of the coaxial cable 3, the socket 21 is driven by the transmission shaft 22 to rotate the locknut 31 of the coaxial cable 3 positively, avoiding damage. Even if the locknut 31 starts to wear, the socket 21 can still positively rotate the locknut 31.

Figure 8:
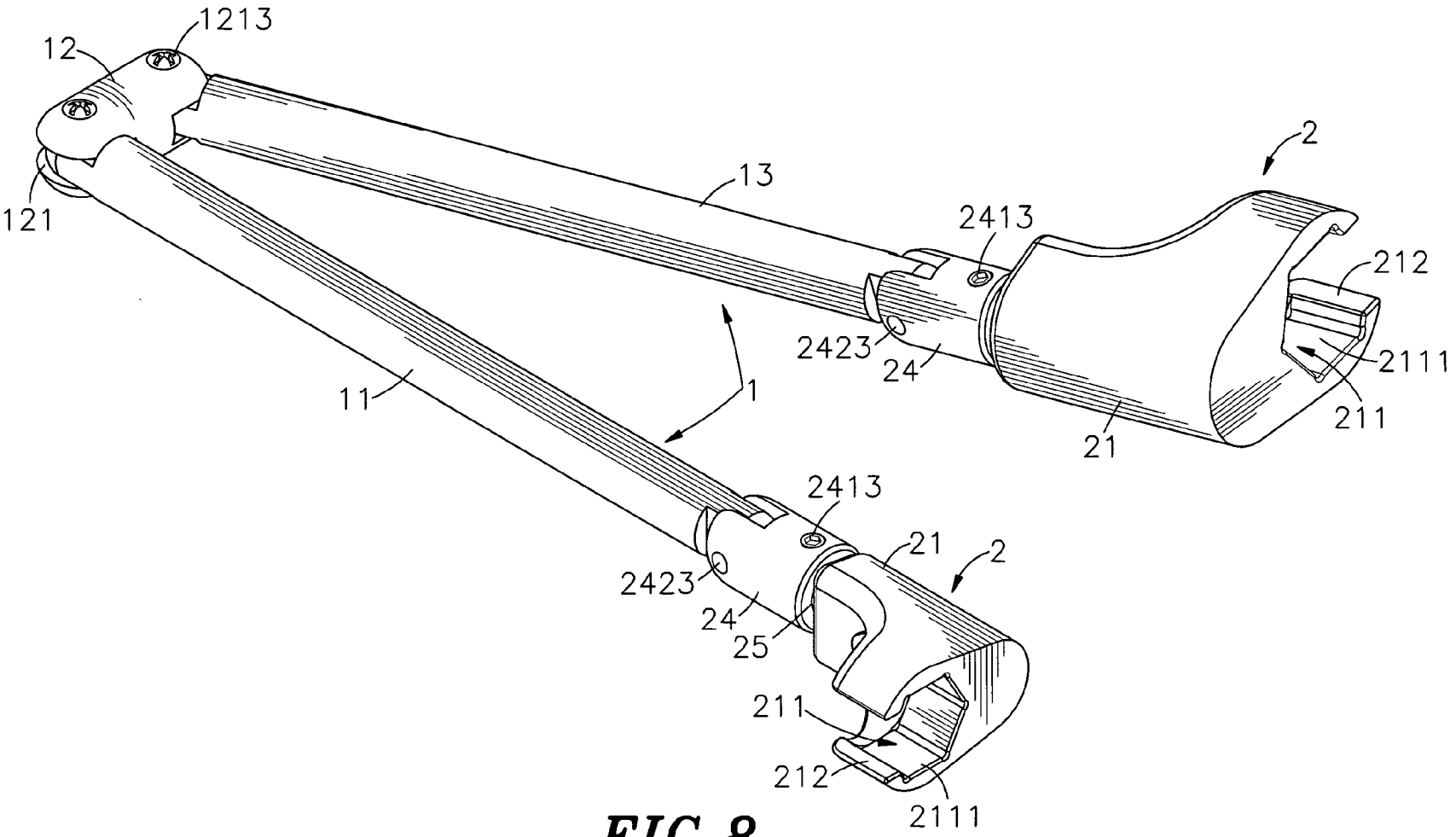
FIG. 8 is an elevational view of a hand tool in accordance with a second embodiment of the present invention.
Figure 9:
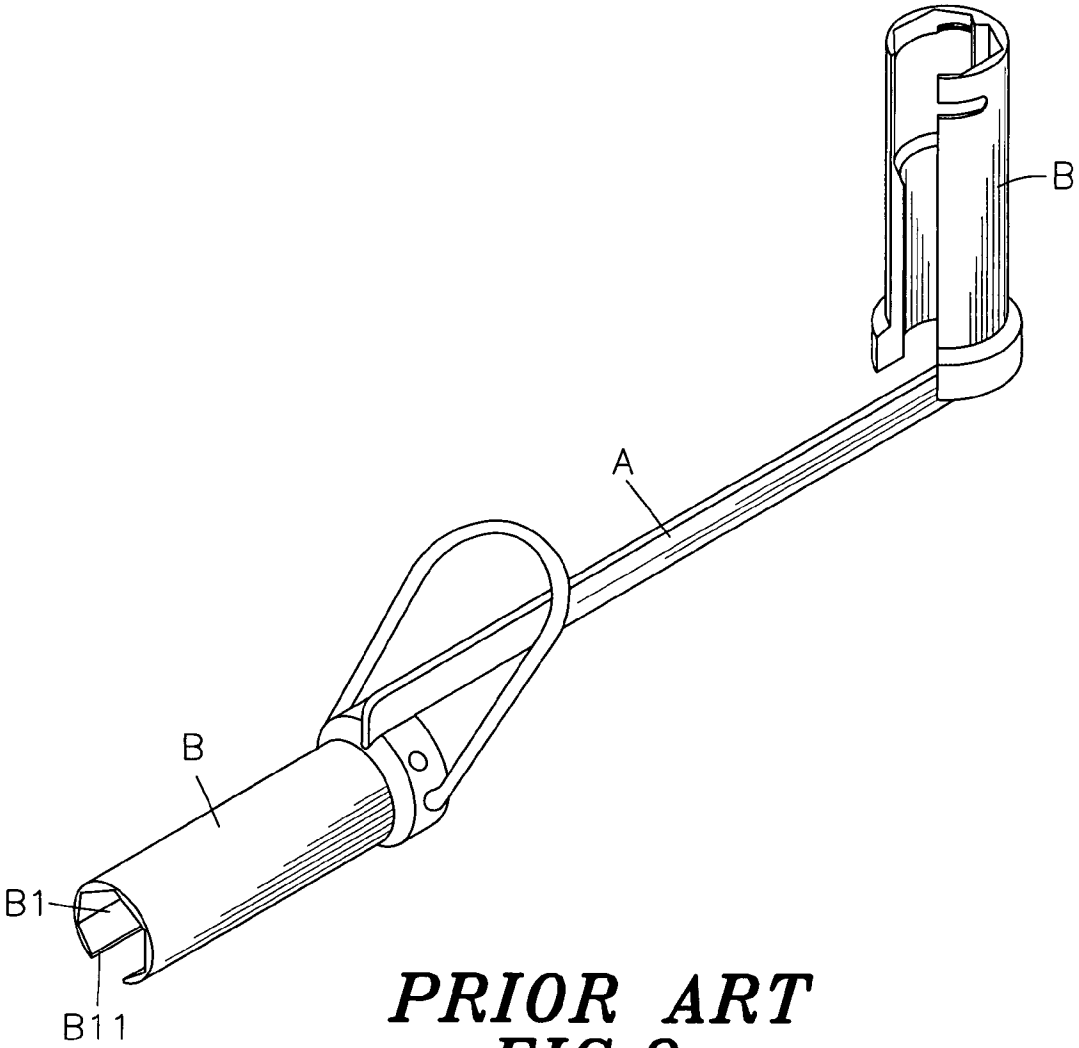
PRIOR ART FIG. 9
FIG. 9 is an elevational view of a hand tool according to the prior art.

FIG. 8 illustrates a hand tool in accordance with a second embodiment of the present invention. According to this second embodiment, the hand tool comprises the tool shaft 1 and two tool heads 2. The two tool heads 2 are respectively coupled to the distal end of the shank 11 and the distal end of the handle 13. Similar to the aforesaid first embodiment of the present invention, the tool head 2 of this second embodiment comprises the socket 21, the transmission shaft 22, an elastic member, for example, the compression spring 23, and the connection member 24. The structural features of the socket 21, the transmission shaft 22, the compression spring 23 and the connection member 24 of each tool head 2 are same as the aforesaid first embodiment of the present invention. Further, the sockets 21 of the two tool heads 2 can be prepared subject to two different specifications or different patterns for rotating different locknuts.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A tool configured to receive a locknut of a coaxial cable, comprising:

a sleeve provided with a first inner hole therein;

a cylindrical body in said first inner hole, wherein said cylindrical body has a surface at a reference plane substantially vertical to an axis of said first inner hole;

a first block in said first inner hole, wherein said first block joins said cylindrical body and protrudes from said surface of said cylindrical body;

a second block in said first inner hole; and a third block in said first inner hole, wherein said first block is configured to be between said second and third blocks, wherein said first block has a first surface configured to contact said second block and a second surface configured to contact said third block, wherein an angle of said first surface of said first block from said reference plane is less than that of said second surface of said first block from said reference plane.

2. The tool of claim 1 further comprising a shaft body joining a top side of said cylindrical body, wherein said surface of said cylindrical body is at a bottom side of said cylindrical body, wherein said cylindrical body has a transverse width greater than that of said shaft body, wherein said first block downwardly protrudes from said surface of said cylindrical body.

3. The tool of claim 2, wherein said first block has a gradually small transverse width from top to bottom along said axis of said first inner hole.

4. The tool of claim 2 further comprising a coil spring in said first inner hole and over said top side of said cylindrical body, wherein said coil spring is sleeved around said shaft body.

5. The tool of claim 4 further comprising a bushing at a top end of said first inner hole, wherein said bushing is sleeved around said shaft body, wherein said coil spring has a top end stopping at said bushing and a bottom end stopping at said cylindrical body.

6. The tool of claim 2, wherein said shaft body is integral with said cylindrical body.

7. The tool of claim 2 further comprising a connection member provided with a second inner hole therein receiving a top portion of said shaft body and a rod inserted into said connection member and said shaft body in a first direction substantially vertically to said axis of said first inner hole.

8. The tool of claim 7 further comprising a shank with two opposing planar surfaces at a first end of said shank, wherein a pivot hole cuts through said opposing planar surfaces, wherein said pivot hole is pivotally connected to said connection member, wherein a notch between two sidewalls of said connection member receives said opposing planar surfaces, and a pin passing through said sidewalls of said connection member and said pivot hole in a second direction substantially vertical to said axis and said first direction, wherein said shank is configured to rotate relatively to said connection member.

9. The tool of claim 1 further comprising a pair of opposing bearing portions configured to fit with a hexagonal periphery of said locknut.

10. The tool of claim 1 further comprising a coil spring in said first inner hole and over a top side of said cylindrical body, wherein said surface of said cylindrical body is at a bottom side of said cylindrical body, wherein said first block downwardly protrudes from said surface of said cylindrical body.

11. The tool of claim 10 further comprising a stop element at a top end of said first inner hole, wherein said coil spring has a top end stopping at said stop element and a bottom end stopping at said cylindrical body.

12. The tool of claim 1 further comprising a non-enclosed ring laterally beside said sleeve, wherein said non-enclosed ring is configured to fit with a hexagonal periphery of said locknut.

13. A tool comprising:

a shank;

a coupling block having a first end pivotally coupled to a first end of said shank, wherein said coupling block is configured to rotate relatively to said shank in a first plane; and a tool head pivotally coupled to a second end of said shank, opposite to said first end of said shank, wherein said tool head is configured to receive a locknut of a coaxial cable.

14. The tool of claim 13, wherein said tool head is configured to rotate relatively to said shank in a second plane different from said first plane.

15. The tool of claim 13 further comprising a handle pivotally coupled to a second end of said coupling block, opposite to said first end of said coupling block, wherein said handle is configured to rotate relatively to said coupling block substantially in said first plane.

16. The tool of claim 13, wherein said tool head comprises a non-enclosed ring configured to fit with a hexagonal periphery of said locknut.

17. A tool comprising:

a tool shaft;

a tool head pivotally coupled to said tool shaft, wherein said tool head is configured to rotate relatively to said tool shaft, wherein said tool head configured to receive a locknut of a coaxial cable;

a cylindrical body;

a first block joining said cylindrical body and protruding from a surface of said cylindrical body at a reference plane;

a second block; and a third block with a space to said second block for receiving said first block, wherein said first block is configured to be between said second and third blocks, wherein said first block has a first surface configured to contact said second block and a second surface configured to contact said third block.

18. The tool of claim 17, wherein an angle of said first surface of said first block from said reference plane is less than that of said second surface of said first block from said reference plane.

19. The tool of claim 17, wherein said tool head comprises a non-enclosed ring configured to fit with a hexagonal periphery of said locknut.

20. The tool of claim 17, wherein said tool shaft comprises two opposing planar surfaces at an end of said tool shaft, wherein a pivot hole cuts through said opposing planar surfaces, wherein said pivot hole is pivotally connected to said tool head, wherein a notch between two sidewalls of said tool head receives said opposing planar surfaces, further comprising a pin passing through said sidewalls of said tool head and said pivot hole.

* * * * *